US006044127A

United States Patent [19]

Van Bree et al.

[11] Patent Number: 6,044,127

[45] Date of Patent: Mar. 28, 2000

[54] X-RAY EXAMINATION APPARATUS INCLUDING AN EXPOSURE CONTROL SYSTEM AND A METHOD OF CONTROLLING AN AMPLIFIER OF AN IMAGE PICK-UP APPARATUS

[75] Inventors: Martinus H. F. J. Van Bree, Eindhoven; Mario Van Den Bogaard, Helmond, both of Netherlands

[73] Assignee: U.S. Philips Corporation, New York, N.Y.

[21] Appl. No.: 08/952,234

[22] PCT Filed: Mar. 24, 1997

[86] PCT No.: PCT/IB97/00291

§ 371 Date: Nov. 10, 1997

§ 102(e) Date: Nov. 10, 1997

[87] PCT Pub. No.: WO97/36460

PCT Pub. Date: Oct. 2, 1997

[30] Foreign Application Priority Data

Mar. 27, 1996 [EP] European Pat. Off. ..... 96200830

[51] Int. Cl.[7] ..... H05G 1/64

[52] U.S. Cl. ..... 378/98.7; 378/98.2

[58] Field of Search ..... 378/98.7, 98.2

[56] References Cited

U.S. PATENT DOCUMENTS 4,703,496 10/1987 Meccariello et al. ..... 378/99

5,461,658 10/1995 Joosten ..... 378/98.7

*Primary Examiner*—Craig E. Church

*Attorney, Agent, or Firm*—Dwight H. Renfrew

[57] ABSTRACT

An X-ray examination apparatus is arranged to convert an X-ray image of an object into an optical image, and to derive an image signal from the optical image by means of an image pick-up apparatus. The image pick-up apparatus includes a controllable amplifier. The X-ray examination apparatus includes an exposure control system with a photosensor for measuring the brightness of the optical image. The exposure control system adjusts the controllable amplifier on the basis of the photosensor signal, representing the brightness of the optical image, and a correction number. The correction number is derived from the image signal.

8 Claims, 2 Drawing Sheets

X-RAY EXAMINATION APPARATUS INCLUDING AN EXPOSURE CONTROL SYSTEM AND A METHOD OF CONTROLLING AN AMPLIFIER OF AN IMAGE PICK-UP APPARATUS

BACKGROUND OF THE INVENTION

1. Field of the Invention

The invention relates to an X-ray examination apparatus which includes an X-ray detector for deriving an optical image from an X-ray image, an image pick-up apparatus for picking up the optical image and including a controllable amplifier for producing an image signal and an exposure control system for adjusting the controllable amplifier. The invention also relates to a method of controlling a controllable amplifier of an image pick-up apparatus for picking up an image, in which the controllable amplifier produces an image signal representing image information in the image.

2. Description of the Related Art

An X-ray examination apparatus of this kind is known from U.S. Pat. No. 4,703,496. A method of the kind set forth is apparent from the operation of the X-ray examination apparatus described in the cited patent.

The known X-ray examination apparatus includes an image intensifier pick-up chain with an X-ray image intensifier and an image pick-up apparatus in the form of a video camera. The X-ray image intensifier converts an X-ray image into an optical image and the video camera derives the image signal from the optical image. The video camera includes a controllable amplifier. The exposure control system includes a photosensor for measuring a brightness value of the optical image. The photosensor signal represents the mean brightness in the optical image. Furthermore, the photosensor signal anticipates the desired gain factor of the controllable amplifier. This means that the amplifier is adjusted on the basis of the mean brightness of the optical image, and hence that the amplifier is adjusted to bring the signal level of the image signal within a desired range. The image signal is applied to a monitor for displaying the image information of the X-ray image.

The transfer characteristic between the optical image on the exit window of the X-ray image intensifier and the output of the video camera is required for the adjustment of the amplifier of the known X-ray examination apparatus on the basis of the mean brightness of the optical image. The transfer characteristic describes the relation between the signal level of the image signal and the brightness of the optical image. Because the transfer characteristic is complex, notably non-linear, complex and time-consuming calculations are required so as to achieve accurate adjustment of the controllable amplifier. Consequently, either much time is lost before the controllable amplifier has been suitably adjusted or the amplifier is inaccurately adjusted. In the latter case image information of the X-ray image will be lost, or not clearly reproduced. If too much time is required for accurate adjustment of the controllable amplifier, image information of a fast succession of X-ray images cannot be reproduced without giving rise to disturbances in the image signal.

SUMMARY OF THE INVENTION

It is an object of the invention to provide an X-ray examination apparatus with an exposure control system which improves the accuracy of adjustment of the controllable amplifier and reduces the time required for adjusting the controllable amplifier.

This object is achieved by means of an X-ray examination apparatus according to the invention which is characterized in that the exposure control system is arranged to adjust the controllable amplifier on the basis of the image signal and a brightness value of the optical image.

The photosensor of the exposure control system produces a photosensor signal which represents the mean brightness value in a measuring field. The measuring field is usually a disc-shaped region at the center of the optical image; however, other measuring fields may also be used. The measuring field preferably covers a part of the optical image which contains interesting image information. The arithmetic unit calculates an estimate of the mean signal level of the image signal on the basis of a simplified approximation of the transfer characteristic. The gain of the controllable amplifier is adjusted on the basis of said estimate. The simplified approximation of the transfer characteristic is adapted on the basis of the signal level of the image signal available on the output of the image pick-up apparatus. The simplified approximation can thus be chosen so that the gain is accurately adjusted.

Because the photosensor very quickly measures the mean brightness in the measuring field, the gain can be suitably adjusted before the amplifier supplies the image signal of the current optical image; it is thus achieved that the signal level of the image signal is situated in a desired range. The simplified approximation can be adapted on the basis of the image signal of a preceding optical image or on the basis of a part of the image signal which precedes the part of the image signal currently being built up by the image pick-up apparatus.

The desired gain of the controllable amplifier can be separately adjusted. If the measuring field is adjustable, for example on the basis of image information in the X-ray image or the optical image, the (size of the) adjusted measuring field is preferably taken into account. For example, as the measuring field is smaller, the desired gain will be higher.

A preferred embodiment of an X-ray examination apparatus according to the invention in which the exposure control system includes a photosensor for producing a photosensor signal which represents said brightness value of the optical image,is characterized in that the exposure control system is arranged to adjust the controllable amplifier by means of a gain control signal and includes an arithmetic unit for deriving the gain control signal from the photosensor signal and a correction number and for deriving the correction number from the image signal, the correction number representing a variation of a signal level of the image signal due to a substantially constant brightness value of the optical image.

The arithmetic unit derives a correction number from the signal level of the actual image signal available on the output of the image pick-up apparatus. This correction number represents the deviation between the simplified approximation of the transfer characteristic and the real transfer characteristic applicable to the relevant optical image. Using said correction number and the estimated mean signal level, the arithmetic unit calculates the gain control signal in order to adjust the controllable amplifier so that from the relevant optical image there is derived an image signal whose signal level is situated within a desired range. The estimation and the correction require only simple calculations which are not very time consuming.

A further preferred embodiment of an X-ray examination apparatus according to the invention is characterized in that the image pick-up apparatus is arranged to derive the image signal from one or more optical images during a period of time, that the exposure control system is arranged to derive successive values of the correction number during said period of time, and to derive a next value of the correction number from a previous value of the correction number, the current signal level and the desired signal level of the image signal.

In order to obtain dynamic information, a series of images are picked up in rapid succession. It is notably possible to reproduce cardiac or peristaltic movement of a patient. The values of the correction number desired to obtain correct adjustment of the controllable amplifier do not deviate too much for successive images. As a result, only small adaptations of the value of the correction number, and hence small adaptations of the gain control signal, will be required. Such small adaptations require little time only and are very accurate. It has been found that the signal level of the image signal is within 5%, usually even within 0.5%, of the desired signal level. Because only small adaptations are required, no or hardly any overshoot occurs of the value of the correction number, which would require further correction.

Iterative extraction of the value of the correction number for an optical image in a series means that the value of the correction number for a previous optical image is taken into account in calculating a new value of the correction number for the current optical image. Because of the iterative extraction, only small adaptations of the value of the correction number are required, which adaptations are not very time consuming. By deriving the correction number from a running average of the signal level of the photosensor signal it is achieved that the differences between successive values of the correction number will not become excessive. At any instant the running average amounts to the mean value in time of the signal level during a predetermined period of time which directly precedes the relevant instant. As a result, the simplified approximation for estimating the signal level of the image signal can be adapted while an individual image is being reproduced, without giving rise to annoying brightness variations in the image reproduced.

A further preferred embodiment of an X-ray examination apparatus according to the invention is characterized in that the arithmetic unit is arranged to adjust the contribution of the previous value of the correction number to the next value of the correction number.

When the contribution of the previous value of the correction number is suitably chosen during the iterative calculation, it is achieved that undesirable differences between electronic image signals of successive optical images do not excessively influence the adjustment of the controllable amplifier. For example, a possible disturbance in the image signal is taken into account for only a small part in forming the gain control signal for a next optical image in which the disturbance has meanwhile (partly) disappeared.

It is also an object of the invention to provide a method enabling faster and more accurate adjustment of the controllable amplifier of the image pick-up apparatus than the known method. To achieve this, the method according to the invention, where the controllable amplifier forms an image signal representing image information in the image, is characterized in that the controllable amplifier is adjusted on the basis of the image signal and a brightness value of the image.

The method according to the invention offers fast and accurate adjustment of the controllable amplifier. It is thus achieved that an X-ray image of high diagnostic quality can be reproduced without substantial loss of time. Therefore, the method according to the invention is particularly suitable for use when a series of X-ray images is picked up at a high image rate.

These and other aspects of the invention will be apparent from and elucidated with reference to the embodiments described hereinafter.

DESCRIPTION OF THE PREFERRED EMBODIMENTS

Figure 1:
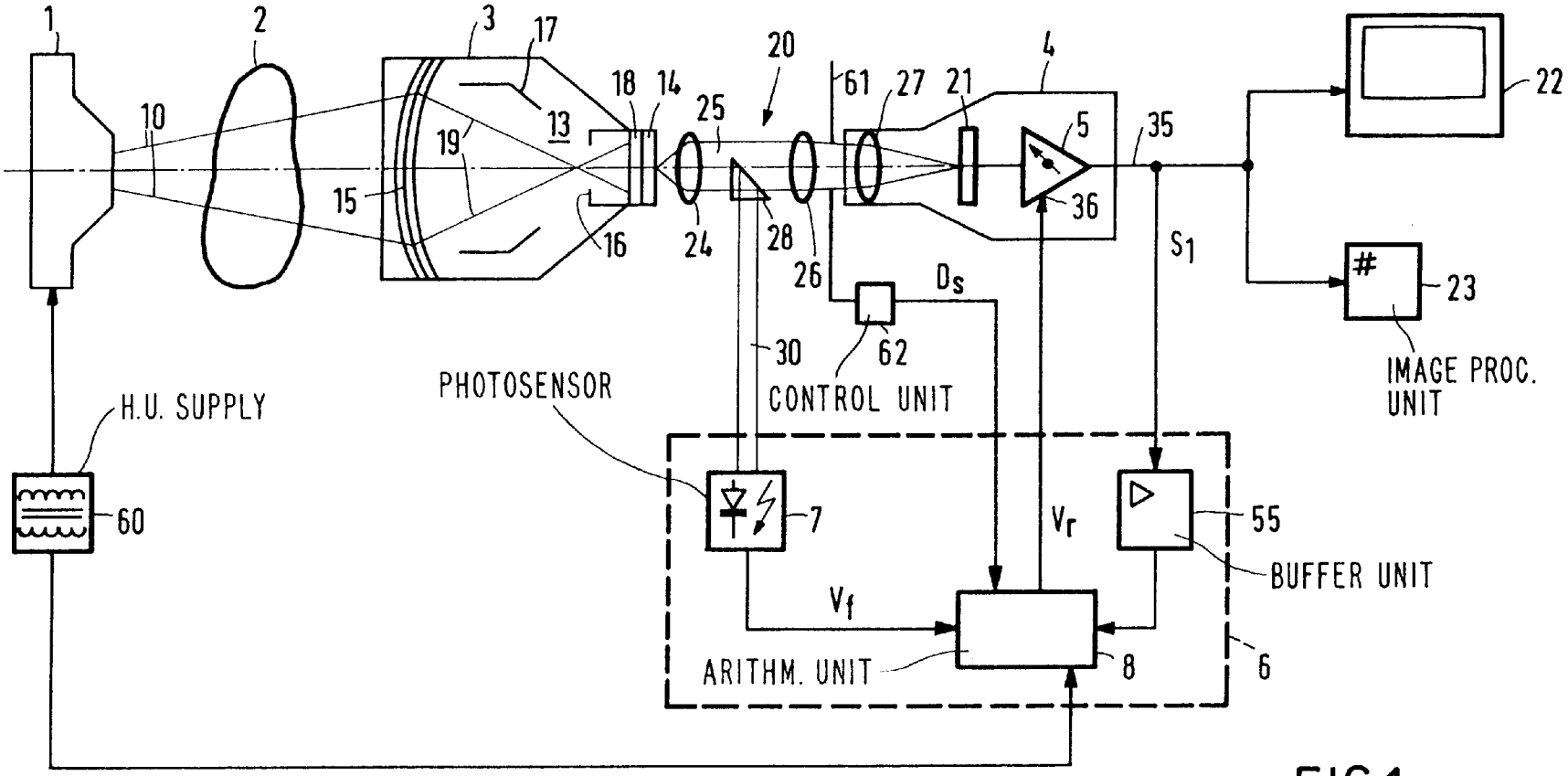
FIG. 1 shows diagrammatically an X-ray examination apparatus in which the invention is used.

FIG. 1 shows diagrammatically an X-ray examination apparatus in which the invention is used. The X-ray source 1 emits an X-ray beam 10 for irradiating an object 2, for example a patient to be radiologically examined. Due to local X-ray absorption differences within the patient, an X-ray image is formed on an X-ray-sensitive surface 11. In the present embodiment the X-ray detector 3 consists of an X-ray image intensifier tube whose entrance screen 11 acts as the X-ray-sensitive surface. The incident X-rays are converted into an electron beam 12 by the entrance screen 11. An electron optical system 13 conducts the electron beam 19 to an exit window 14. The electron-optical system includes a photocathode 15 which forms part of the entrance screen, a hollow anode 16 and alignment electrodes 17. A phosphor layer 18 is provided on the exit window 14. The electron beam 19 incident on the phosphor layer 18 generates the optical image on the exit window. An optical system 20 images the optical image on the exit window onto an image sensor 21, for example a CCD sensor, or a television pick-up tube of the image pick-up apparatus 4. The image pick-up apparatus derives the image signal, for example an electronic video signal, from the optical image, which image signal is subsequently applied to a monitor 22 or to an image processing unit 23. The image signal represents image information of the optical image. The image information of the X-ray image is reproduced on the monitor. The image processing unit further processes the image signal, for example in order to reproduce the image information on a hard copy or to process the image information.

The light beam emanating from the exit window 14 is formed into a parallel beam 25 by the lens 24. The lens 26 and the objective lens 27 of the image pick-up apparatus focus the parallel beam 25 onto the image sensor 21. In the parallel beam 25 there is arranged a beam splitter 28, for example a partly transparent mirror or a small prism. The beam splitter conducts a sub-beam 30, constituting a small part of the parallel beam, to the photosensor 7. The photosensor 7 is, for example a photodiode. The photosensor supplies the arithmetic unit 8 with the photosensor signal which represents the mean brightness of the optical image or of a region of interest in the optical focus imaged on the photosensor. The arithmetic unit 8 is coupled to the output terminal 35 of the image pick-up apparatus 4 via a buffer unit 55. The arithmetic unit 8 derives the value of the correction number from the signal level of the electronic image signal. Furthermore, the arithmetic unit 8 calculates a gain control signal on the basis of the photosensor signal, the desired mean signal level of the image signal and the current mean signal level of the image signal. The gain control signal is applied to a control input 36 of the controllable amplifier 5. The gain control signal adjusts the controllable amplifier in such a manner that the signal level of the electronic image signal is situated in a desired range in order to ensure that the image information in the image signal is suitably visibly reproduced. For example, it is achieved that no or hardly any overexposed or underexposed regions occur in the display of the image information on the monitor 22.

Figure 2:
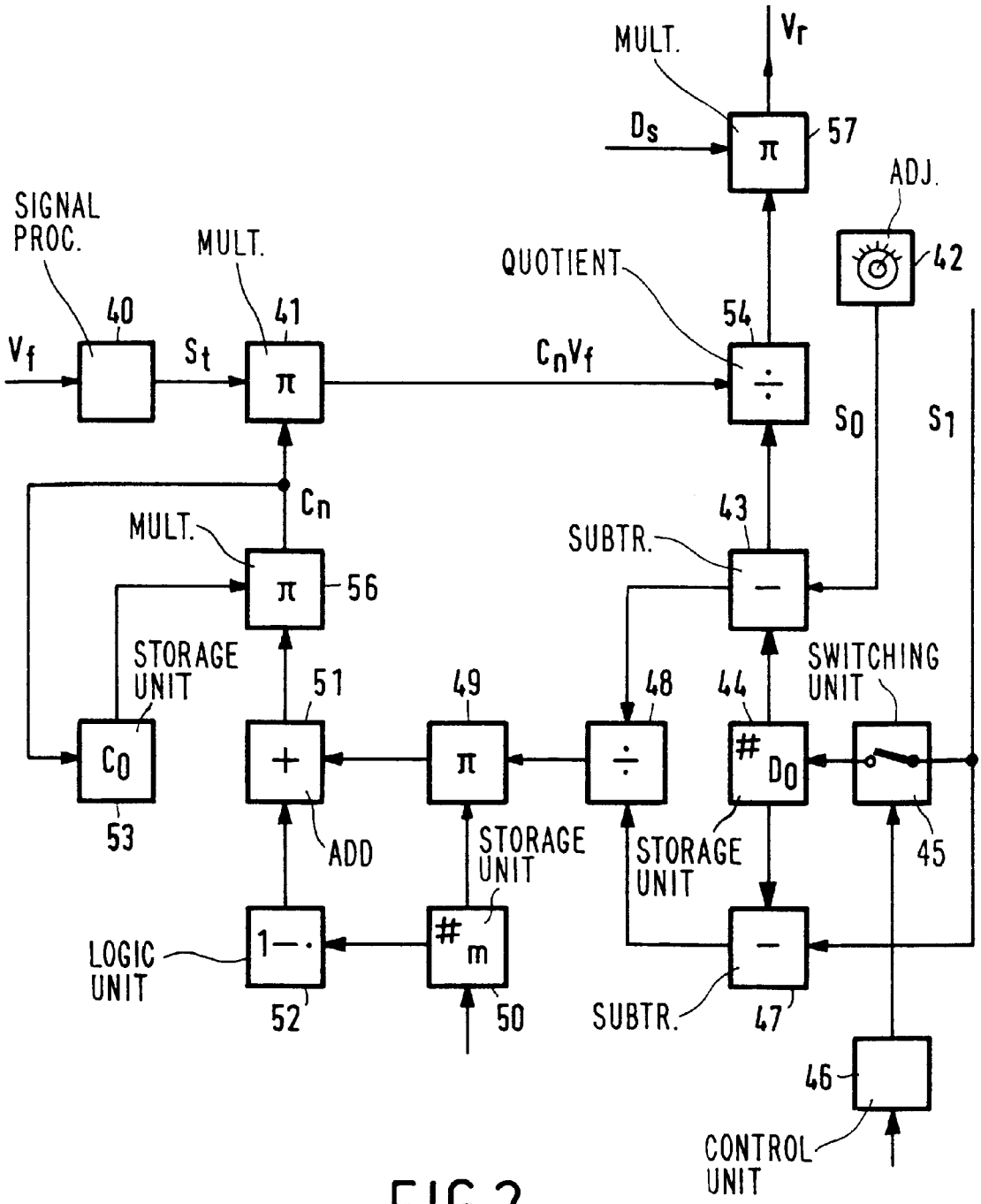
FIG. 2 shows diagrammatically details of the exposure control system of the X-ray examination apparatus shown in FIG. 1.

FIG. 2 shows diagrammatically details of the exposure control system of the X-ray examination apparatus of FIG. 1. A signal processing unit 40 receives the photodiode voltage $V_f$ wherefrom the photosensor signal $S_f$ is derived. The photosensor signal is multiplied by the correction number $C_n$ by means of a multiplier 41. The desired mean signal level $S_o$ of the image signal is selected by means of an adjusting unit 42 and applied to a subtracter 43. For the adjustment of the desired mean signal level, preferably the (size of the) measuring field used for measuring the mean brightness in the optical image is taken into account. The measuring field can be adjusted, for example automatically on the basis of image information as is known per se from European Patent Application EP 0 629 105, which corresponds to U.S. Pat. No 5,961,658. The subtracter 43 subtracts a dark level from the desired signal level $S_o$.

The dark level is the signal level of the image signal obtained when no light is incident on the image sensor. This dark level is recorded, for example in the storage unit 44 while the X-ray source is not in operation. To this end, the storage unit 44 is coupled, via a switching unit 45, to the output of the image pick-up apparatus 4. The switching unit 45 is controlled by a control unit 46 which is coupled to the high voltage supply 60 of the X-ray source. The high voltage supply 60 supplies the arithmetic unit 8 with a stop signal when the X-ray source is not in operation. The control unit 46 controls the switching unit 45 on the basis of said stop signal.

The mean signal level of the image signal $S_1$ is derived from buffer unit 55 (FIG. 1). The dark level $D_o$ is subtracted from the mean signal level $S_1$ by means of a subtracter 47. The difference signals $S_1-D_0$ and $S_0-D_0$ of the respective subtracters 43 and 47 are applied to a quotient unit 48 which calculates the ratio $$\left[\frac{S_1 - D_0}{S_0 - D_0}\right]$$

The ratio multiplied by an adjustable weighting factor m by the multiplier 49. The value of the adjustable weighting factor m is derived from a storage unit 50. The output of the multiplier 49 is coupled to an adder unit 51. The adder unit 51 also receives the value l−m derived from the value of m in the storage unit 50 by a logic unit 52. The output of the adder unit carries a signal level $$(1-m)+m\left[\frac{S_1 - D_0}{S_0 - D_0}\right]$$

which is applied to a multiplier 56. A storage unit 53 contains a previous value $C_0$ of the correction number for supply to the multiplier 56. The output of the multiplier 56 then carries the updated value $C_n$ of the correction number, for which it holds that:

$$C_n = C_o\left[(1-m)+m\frac{S_1 - D_0}{S_0 - D_0}\right]$$

The updated value $C_n$ is again applied to the storage unit 53 so as to be used as the previous value $C_0$ for the next iteration step. The content of the storage unit is thus updated, it being ensured that the updated value $C_n$ does not deviate excessively from the previous value $C_0$, so that the calculations are accurate and not very time consuming.

The photosensor signal is multiplied by the updated value $C_n$ of the correction number by the multiplier 41. A quotient unit 54 calculates the ratio $(S_0-D_0)/S_fC_n$. The gain control signal having the signal level $(S_0-D_0)/S_fc_n$ then becomes available on the output of the quotient unit 54, in order to be applied to the control input 36 of the controllable amplifier. The signal level of the gain control signal corresponds to the desired gain factor of the controllable amplifier. The ratio $(S_0-D_0)/S_f$ corresponds to a simple approximation of the transfer characteristic and non-linearities in the transfer characteristic are represented by the correction number which is readjusted on the basis of the mean signal level of the image signal. Because this exposure control is not very time consuming, the controllable amplifier can be adjusted without time being lost in forming the image signal at the desired setting of the controllable amplifier. At an image rate of 30 images per second, the gain can be sufficiently quickly and accurately adjusted so as to avoid disturbances in the successively reproduced images, to an acceptable degree.

Preferably, the formation of the gain control signal $V_r$ also takes into account the diaphragm setting of the image pick-up apparatus. In front of the objective lens 27 there is arranged a diaphragm 61 having an adjustable aperture. The diaphragm controls the intensity of the light incident on the image sensor 21. The diaphragm itself is controlled by means of a control unit 62. The control unit supplies the exposure control system with a diaphragm signal $D_s$ which represents the diaphragm aperture. The diaphragm signal is applied to a multiplier 57 which derives a flux reduction factor from the diaphragm signal. The flux reduction factor represents diffraction of the intensity of the light from the exit window which reaches the image sensor. The signal level of the gain control signal is multiplied by the flux reduction factor. The adjustment of the controllable amplifier thus takes into account the setting of the diaphragm.

In a contemporary X-ray examination apparatus the functions of the arithmetic unit are carried out, for example by a suitably programmed computer or a special-purpose electronic (micro)processor.

All references cited herein are incorporated herein by reference in their entirety and for all purposes to the same extent as if each individual publication or patent or patent application was specifically and individually indicated to be incorporated by reference in its entirety for all purposes.

What is claimed is:

1. An X-ray examination apparatus comprising an X-ray detector for deriving an optical image from an X-ray image, an image pick-up apparatus for picking up the optical image and including controllable amplifier for producing an image signal and, an exposure control system for providing an estimate of a transfer characteristic of the image pick-up apparatus and for adjusting the controllable amplifier on the basis of the estimated transfer characteristic and a brightness value of the optical image, whereby the signal level of the image signal is situated in a desired range.

2. An X-ray examination apparatus as claimed in claim 1, wherein the exposure control system is arranged to adjust the controllable amplifier by means of a gain control signal, and wherein the exposure control system further comprises a photosensor for producing a photosensor signal which represents said brightness value of the optical image, and an arithmetic unit for deriving the gain control signal from the photosensor signal and a correction number, and for deriving the correction number from the image signal, the correction number representing a deviation between a simplified approximation of the transfer characteristic and the real transfer characteristic applicable to the optical image.

3. An X-ray examination apparatus as claimed in claim 2, wherein the arithmetic unit is arranged to derive the correction number from a current image signal level and a desired signal level of the image signal.

4. An X-ray examination apparatus as claimed in claim 3, wherein the image pick-up apparatus is arranged to derive a plurality of image signals from a plurality of optical images during a period of time, and wherein the exposure control system is arranged to derive a plurality of successive values of the correction number during said period of time, a next value of the correction number being derived from a previous value of the correction number, the current signal level and the desired signal level of the image signal.

5. An X-ray examination apparatus as claimed in claim 4, wherein the arithmetic unit is arranged to adjust the contribution of the previous value of the correction number to the next value of the correction number.

6. The apparatus of claim 2 wherein the correction number further represents a variation of a signal level of the image signal due to a substantially constant brightness value of the optical image.

7. The apparatus of claim 2 wherein the correction number further represents non-linearities in the real transfer characteristic.

8. A method of controlling a controllable amplifier of an image pick-up apparatus, the image pick-up apparatus for picking up an optical image, the controllable amplifier for producing an image signal representing image information in the optical image, said method comprising providing a brightness value of the optical image, providing an estimate of a transfer characteristic of the image pick-up apparatus, and adjusting the controllable amplifier on the basis of the estimated transfer characteristic and the brightness value of the optical image, whereby the signal level of the image signal is situated in a desired range.

* * * * *